US010345024B2

(12) United States Patent
Besore et al.

(10) Patent No.: US 10,345,024 B2
(45) Date of Patent: Jul. 9, 2019

(54) BARREL ICE MAKER

(71) Applicant: Haier US Appliance Solutions, Inc., Wilmington, DE (US)

(72) Inventors: John Keith Besore, Prospect, KY (US); Brent Alden Junge, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 88 days.

(21) Appl. No.: 15/828,724

(22) Filed: Dec. 1, 2017

(65) Prior Publication Data

US 2019/0170420 A1 Jun. 6, 2019

(51) Int. Cl.

| | |
|---|---|
| ***F25C 1/00*** | (2006.01) |
| ***F25C 1/04*** | (2018.01) |
| ***F25C 1/24*** | (2018.01) |
| ***F25C 5/02*** | (2006.01) |

(52) U.S. Cl.

CPC ..... *F25C 1/04* (2013.01); *F25C 1/24* (2013.01); *F25C 5/02* (2013.01); *F25C 2400/10* (2013.01); *F25C 2500/02* (2013.01)

(58) Field of Classification Search

CPC ..... F25C 1/06; F25C 1/04; F25C 5/02; F25C 5/04; F25C 5/06; F25C 2700/08

See application file for complete search history.

(56) References Cited

U.S. PATENT DOCUMENTS

| | | | | |
|---|---|---|---|---|
| 2,717,499 | A | 9/1955 | Ashby et al. | |
| 2,717,500 | A | 9/1955 | Ploeger | |
| 2,799,144 | A | 7/1957 | Barton | |
| 2,947,156 | A | 8/1960 | Roedter | |
| 2,969,651 | A | 1/1961 | Bauerlein | |
| 3,163,018 | A * | 12/1964 | Shaw | F25C 1/04 62/137 |
| 3,300,998 | A | 1/1967 | Jacobus et al. | |
| 3,375,678 | A | 4/1968 | Jacobus et al. | |
| 3,397,553 | A | 8/1968 | Crowe et al. | |
| 3,407,619 | A | 10/1968 | Walker | |
| 3,654,772 | A | 4/1972 | Curry, III | |
| 3,678,701 | A | 7/1972 | Powell et al. | |
| 3,690,120 | A | 9/1972 | Scheldorf et al. | |
| 3,850,008 | A | 11/1974 | Frazier | |
| 3,913,350 | A | 10/1975 | Alvarez | |
| 4,059,970 | A | 11/1977 | Loeb | |
| 4,429,550 | A | 2/1984 | Latter | |
| 9,234,689 | B2 | 1/2016 | Son et al. | |

* cited by examiner

*Primary Examiner* — Edward F Landrum
*Assistant Examiner* — Kamran Tavakoldavani
(74) *Attorney, Agent, or Firm* — Dority & Manning, P.A.

(57) ABSTRACT

An ice maker includes a mold cavity. The mold cavity extends between a floor and an opening along a longitudinal axis. A first arm and a second arm are connected to opposite sides of an ejector pad and extend upward from the ejector pad. The ejector pad is movable via the first and second arms between a low position and a high position and can eject ice from the mold cavity when the ejector pad moves from the low position to the high position. A related refrigerator appliance is also provided.

20 Claims, 9 Drawing Sheets

BARREL ICE MAKER

FIELD OF THE INVENTION

The present subject matter relates generally to ice makers, and in particular to ice makers for forming barrel ice.

BACKGROUND OF THE INVENTION

Certain refrigerator appliances include an ice maker. An ice maker may also be a stand-alone appliance designed for use in commercial and/or residential kitchens. To produce ice, liquid water is directed to the ice maker and frozen. A variety of ice types can be produced depending upon the particular ice maker used. For example, certain ice makers include a mold body for receiving liquid water. The shape of the ice produced in such ice makers will generally correspond to the shape of the mold body. For example, refrigerator ice makers and other residential ice makers commonly include a mold body which produces crescent-shaped ice.

Many consumers, however, prefer barrel ice, which may be generally cylindrical in shape, over crescent-shaped ice pieces. Past attempts at providing an ice maker which produces barrel-shaped ice have met with difficulty. For example, some ice makers include a mold body with cylindrical mold cavities, where ice is harvested from the mold cavities by pushing the ice up out of the cavities from below, such as with a piston that passes through the bottom of at least one of the mold cavities. Such ice makers include a seal at the location(s) where the piston passes through the bottom of the mold cavity to prevent liquid water escaping the mold body. The movement of the piston may cause such seals to wear out prematurely.

Accordingly, an ice maker with features for producing and reliably harvesting barrel-shaped ice would be useful.

BRIEF DESCRIPTION OF THE INVENTION

The present subject matter provides an ice maker. The ice maker includes mold cavities shaped to form barrel-shaped ice pieces and features for ejecting the ice from the mold cavities. Such features may include a first arm and a second arm connected to opposite sides of an ejector pad and extending upward from the ejector pad. The ejector pad is movable via the first and second arms between a low position and a high position and can eject ice from the mold cavity when the ejector pad moves from the low position to the high position. A related refrigerator appliance is also provided. Additional aspects and advantages of the invention will be set forth in part in the following description, or may be apparent from the description, or may be learned through practice of the invention.

In a first exemplary embodiment, an ice maker is provided. The ice maker defines a vertical direction. The ice maker includes a mold body including a mold cavity. The mold cavity extends between a floor and an opening along a longitudinal axis. The mold cavity is fully enclosed by at least one sidewall between the floor and the opening. The longitudinal axis of the mold cavity is oriented generally along the vertical direction. An ejector pad is disposed proximate to the floor of the mold cavity when the ejector pad is in a low position. A first arm is connected to a first side of the ejector pad and extends upward generally along the vertical direction from the first side of the ejector pad. A second arm is connected to a second side of the ejector pad. The second side of the ejector pad is opposite the first side of the ejector pad. The second arm extends upward generally along the vertical direction from the second side of the ejector pad. A motor is in operative communication with the first arm and the second arm. The motor can move the ejector pad upward generally along the vertical direction from the low position to a high position proximate the opening of the mold cavity. The ejector pad can eject ice from the mold cavity when the ejector pad moves from the low position to the high position.

In a second exemplary embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet that defines a chilled chamber. An ice maker is disposed within the cabinet. The ice maker includes a mold body including a mold cavity. The mold cavity extends between a floor and an opening along a longitudinal axis. The mold cavity is fully enclosed by at least one sidewall between the floor and the opening. The longitudinal axis of the mold cavity is oriented generally along the vertical direction. An ejector pad is disposed proximate to the floor of the mold cavity when the ejector pad is in a low position. A first arm is connected to a first side of the ejector pad and extends upward generally along the vertical direction from the first side of the ejector pad. A second arm is connected to a second side of the ejector pad. The second side of the ejector pad is opposite the first side of the ejector pad. The second arm extends upward generally along the vertical direction from the second side of the ejector pad. A motor is in operative communication with the first arm and the second arm. The motor can move the ejector pad upward generally along the vertical direction from the low position to a high position proximate the opening of the mold cavity. The ejector pad can eject ice from the mold cavity when the ejector pad moves from the low position to the high position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
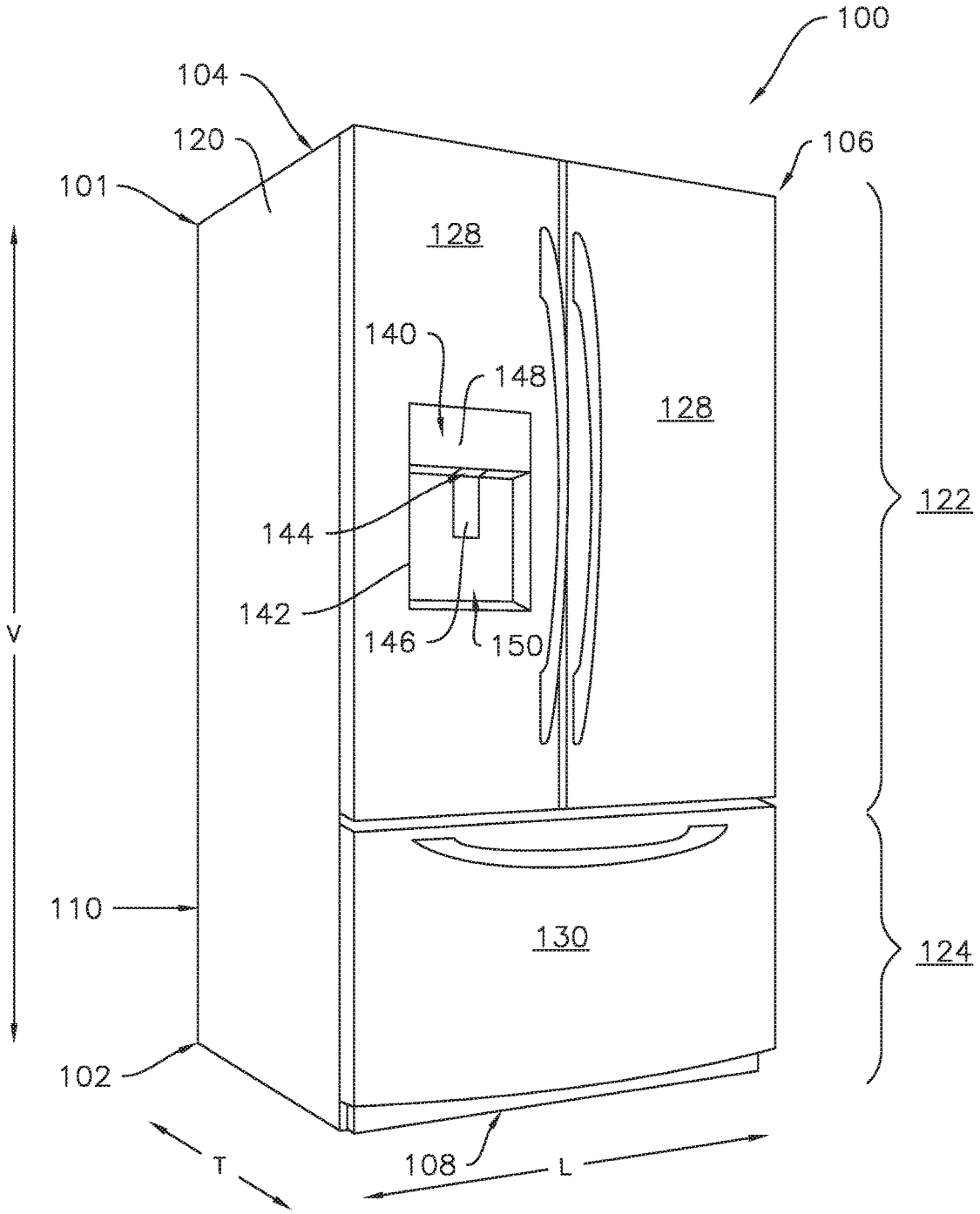
FIG. 1 provides a perspective view of a refrigerator appliance according to one or more exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 120 that generally defines a vertical direction V, a lateral direction L, and a transverse direction T, each of which is mutually perpendicular, such that an orthogonal coordinate system is generally defined. The cabinet 120 extends between a top 101 and a bottom 102 along the vertical direction V, between a left side 104 and a right side 106 along the lateral direction L, and between a front 108 and a rear 110 along the transverse direction T. Housing 120 defines chilled chambers for receipt of food items for storage. In particular, housing 120 defines fresh food chamber 122 positioned at or adjacent top 101 of housing 120 and a freezer chamber 124 arranged at or adjacent bottom 102 of housing 120. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance or a standalone ice maker appliance. Consequently, the description set forth herein is for illustrative purposes only and is not intended to be limiting in any aspect to any particular refrigerator chamber configuration.

Refrigerator doors 128 are rotatably hinged to an edge of housing 120 for selectively accessing fresh food chamber 122, e.g., at the left side 104 and the right side 106. In addition, a freezer door 130 is arranged below refrigerator doors 128 for selectively accessing freezer chamber 124. Freezer door 130 is coupled to a freezer drawer (not shown) mounted within freezer chamber 124 and slidable along the transverse direction T. Refrigerator doors 128 and freezer door 130 are shown in the closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 128. Dispenser 142 includes a discharging outlet 144 for accessing ice and/or liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 128. In the exemplary embodiment, dispenser recess 150 is positioned at a level that approximates the chest level of a user.

Figure 2:
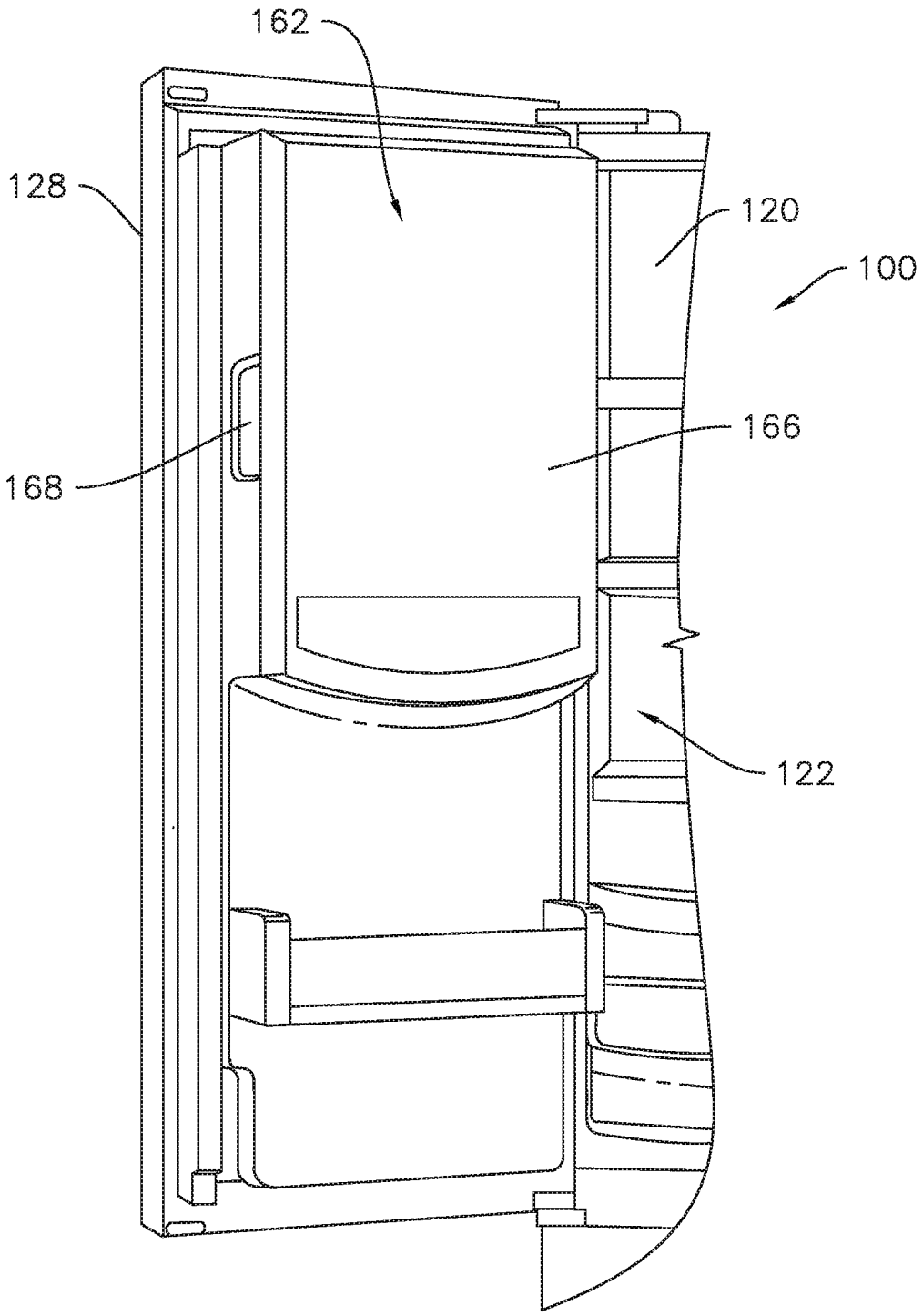
FIG. 2 provides a perspective view of a door of the exemplary refrigerator appliance of FIG. 1.
Figure 3:
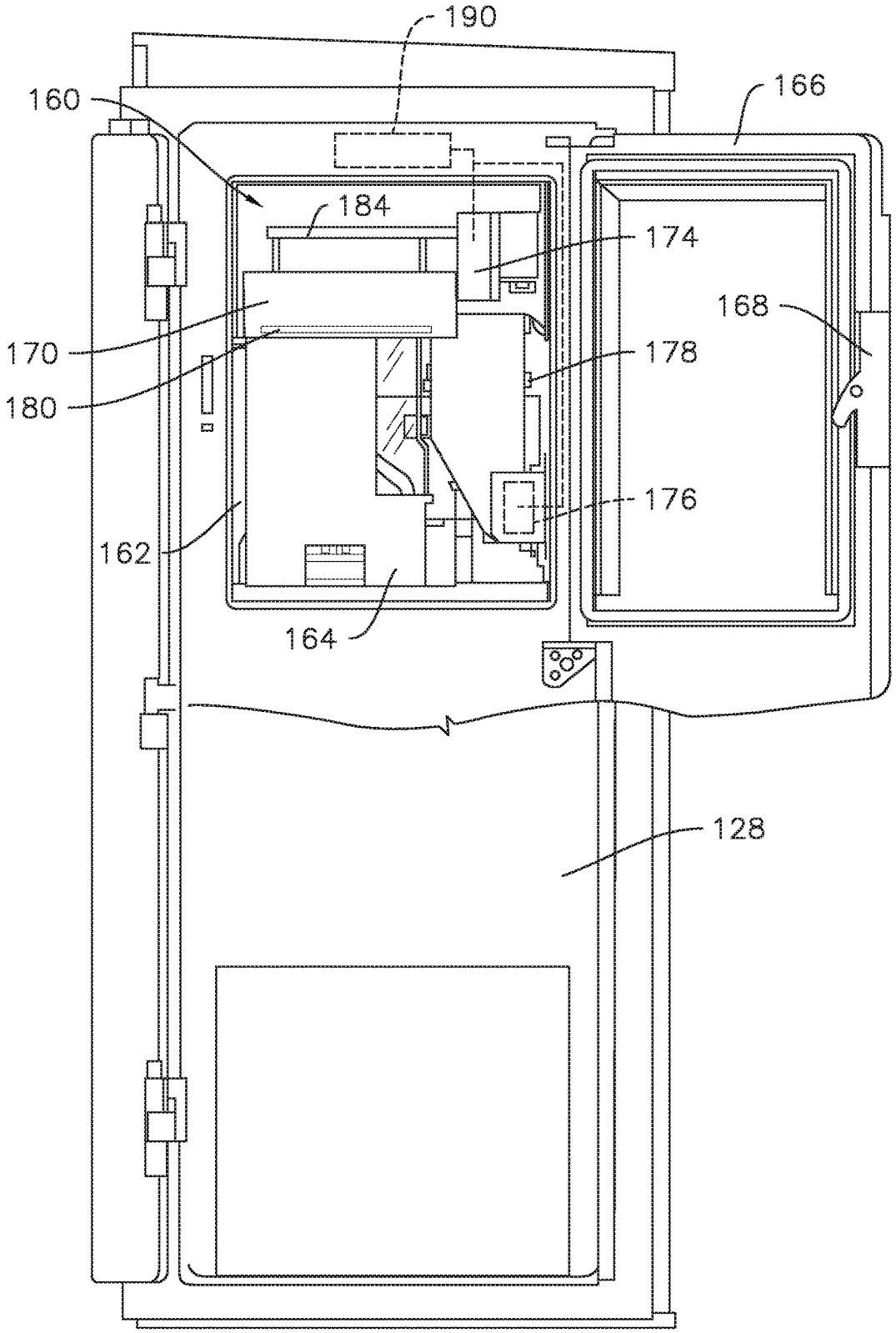
FIG. 3 provides an elevation view of the door of the exemplary refrigerator appliance of FIG. 2 with an access door of the door shown in an open position.

FIG. 2 provides a perspective view of a door of refrigerator doors 128. Refrigerator appliance 100 includes a sub-compartment 162 defined on refrigerator door 128. Sub-compartment 162 may be referred to as an "icebox." Sub-compartment 162 extends into fresh food chamber 122 when refrigerator door 128 is in the closed position. As shown in FIG. 3 and discussed in greater detail below, an ice maker or ice making assembly 160 and an ice storage bin 164 are positioned or disposed within sub-compartment 162. Thus, ice is supplied to dispenser recess 150 (FIG. 1) from the ice maker 160 and/or ice storage bin 164 in sub-compartment 162 on a back side of refrigerator door 128. Chilled air from a sealed system (not shown) of refrigerator appliance 100 may be directed into components within sub-compartment 162, e.g., ice maker 160 and/or ice storage bin 164.

An access door 166 is hinged to refrigerator door 128. Access door 166 permits selective access to sub-compartment 162. Any manner of suitable latch 168 is configured with sub-compartment 162 to maintain access door 166 in a closed position. As an example, latch 168 may be actuated by a consumer in order to open access door 166 for providing access into sub-compartment 162. Access door 166 can also assist with insulating sub-compartment 162, e.g., by thermally isolating or insulating sub-compartment 162 from fresh food chamber 122.

FIG. 3 provides an elevation view of refrigerator door 128 with access door 166 shown in an open position. As may be seen in FIG. 3, ice maker 160 is positioned or disposed within sub-compartment 162. Ice maker 160 includes a mold body or casing 170. As described in more detail below, a motor 174 is mounted within sub-compartment 162, e.g., to mold body 170, and is in mechanical communication with (e.g., coupled to) an ejector pad 210 for ejecting ice from the mold body 170. An ice bucket or ice storage bin 164 is positioned proximate the mold body 170 and receives the ice after the ice is ejected from the mold body 170. From ice storage bin 164, the ice can enter dispensing assembly 140 and be accessed by a user as discussed above. In such a manner, ice maker 160 can produce or generate ice.

Ice maker 160 also includes a fan 176. Fan 176 is configured for directing a flow of chilled air towards mold body 170. As an example, fan 176 can direct chilled air from an evaporator of a sealed system through a duct to mold body 170. Thus, mold body 170 can be cooled with chilled air from fan 176 such that ice maker 160 is air cooled in order to form ice therein. Ice maker 160 also includes a heater 180, such as an electric resistance heating element, mounted to or otherwise in thermal communication with mold body 170. Heater 180 is configured for selectively heating mold body 170, e.g., to assist in ejecting ice from the mold body 170.

Operation of ice maker 160 is controlled by a processing device or controller 190, e.g., that may be operatively coupled to control panel 148 for user manipulation to select features and operations of ice maker 160. Controller 190 can operates various components of ice maker 160 to execute selected system cycles and features. For example, controller 190 is in operative communication with motor 174, fan 176 and heater 180. Thus, controller 190 can selectively activate and operate motor 174, fan 176 and heater 180.

Controller 190 may include a memory and microprocessor, such as a general or special purpose microprocessor operable to execute programming instructions or micro-control code associated with operation of ice maker 160. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Motor 174, fan 176 and heater 180 may be in communication with controller 190 via one or more signal lines or shared communication busses.

Ice maker 160 also includes a temperature sensor 178. Temperature sensor 178 is configured for measuring a temperature of mold body 170 and/or liquids, such as liquid water, within mold body 170. Temperature sensor 178 can be any suitable device for measuring the temperature of mold body 170 and/or liquids therein. For example, temperature sensor 178 may be a thermistor or a thermocouple or a bimetal. Controller 190 can receive a signal, such as a voltage or a current, from temperature sensor 190 that corresponds to the temperature of the mold body 170 and/or liquids therein. In such a manner, the temperature of mold body 170 and/or liquids therein can be monitored and/or recorded with controller 190. Some embodiments can also include an electromechanical icemaker configured with a bimetal to complete an electrical circuit when a specific temperature is reached. By completion of the circuit, the heater 180 and ejector mechanism would be activated via electrical powering of the motor 174.

Figure 4:
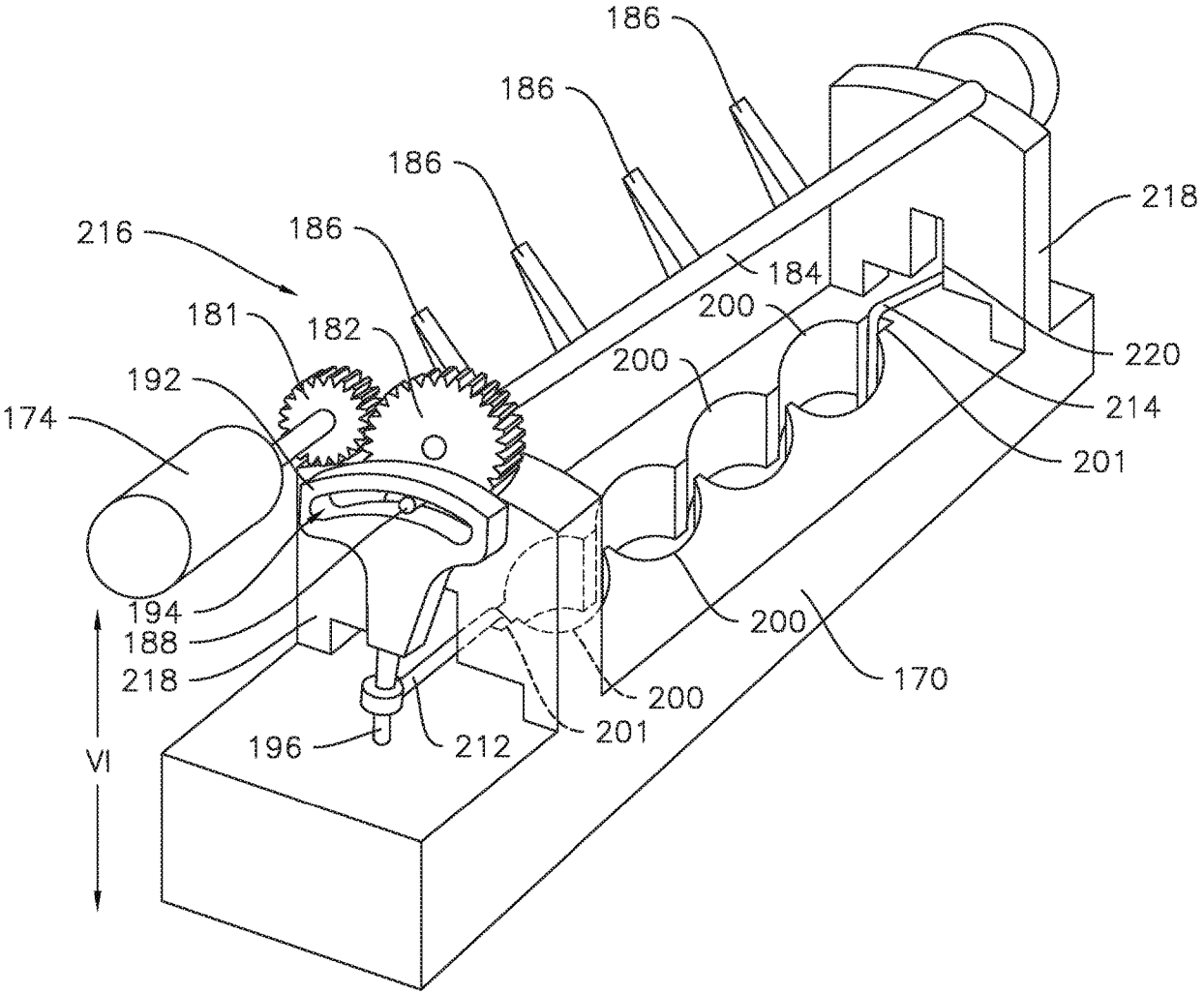
FIG. 4 provides a perspective view of an ice maker according to one or more exemplary embodiments of the present subject matter.

Turning now to FIG. 4, the ice maker 160 defines a vertical direction VI. In exemplary embodiments wherein the ice maker 160 is installed in a refrigerator appliance 100, the ice maker 160 may installed such that the vertical direction VI of the ice maker 160 generally corresponds to the vertical direction V of the cabinet 120. As used herein, terms of approximation such as "generally" or "about" include within ten percent greater or less than the stated value. In the context of an angle or direction, such terms include within ten degrees greater or less than the stated angle or direction. For example, the ice maker 160 may be installed such that the vertical direction VI of the ice maker 160 generally corresponds to the vertical direction V of the cabinet 120 when the vertical direction VI is aligned with, or within ten degrees in any direction of, the vertical direction V.

Figure 5:
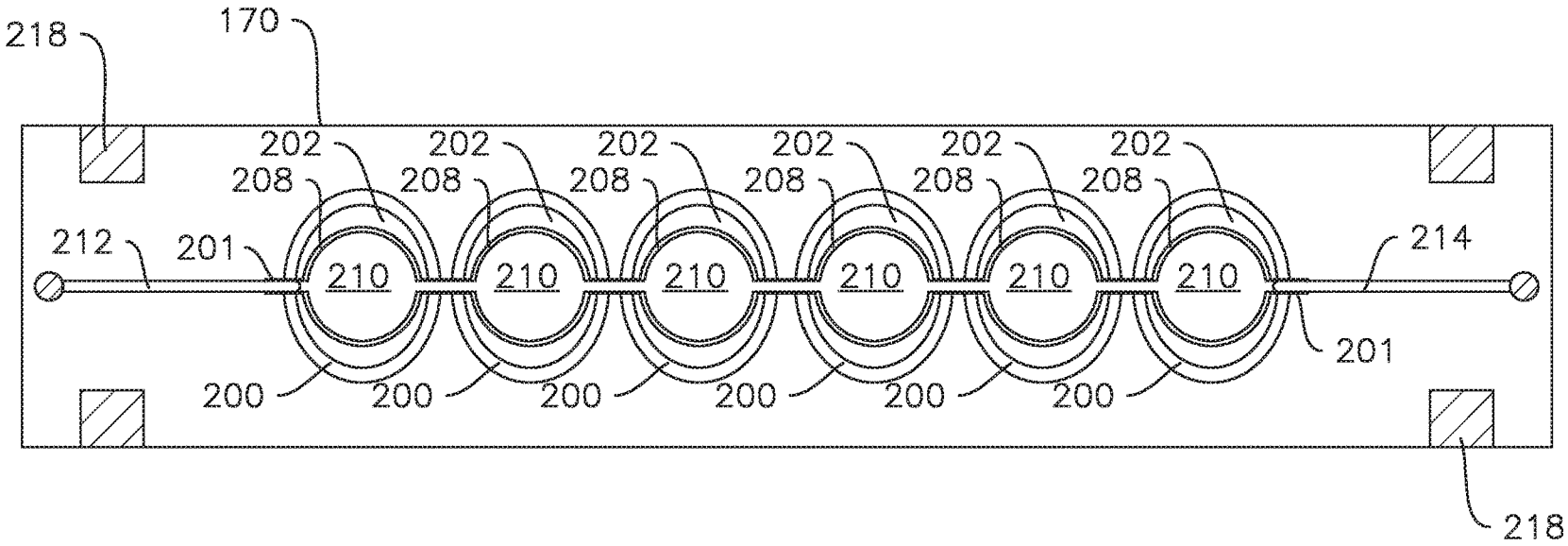
FIG. 5 provides a top-down section view of the ice maker of FIG. 4.

As may be seen in FIGS. 4 and 5, the mold body 170 of ice maker 160 includes at least one mold cavity 200 defined therein. In the example illustrated by FIG. 5, the mold body 170 includes six mold cavities 200. In other embodiments, more or fewer mold cavities 200 may be included. The mold cavity 200 may be configured to receive liquid water to form ice in the mold cavity 200. As will be understood, the shape of ice formed in the mold cavity 200 will correspond to the shape of the mold cavity 200. The mold cavity 200 may be generally cylindrical. Accordingly, generally cylindrical ice, sometimes referred to as "barrel ice," may be produced by the ice maker 160. Example embodiments of the generally cylindrical mold cavity 200 may include tapered sidewalls, e.g., forming an angle of up to ten degrees with a floor 202 of the mold cavity 200. In other embodiments, the mold cavity 200 may have any suitable cross-sectional shape, e.g., hexagonal, instead of a round, e.g., circular or oval, cross-section.

Figure 6:
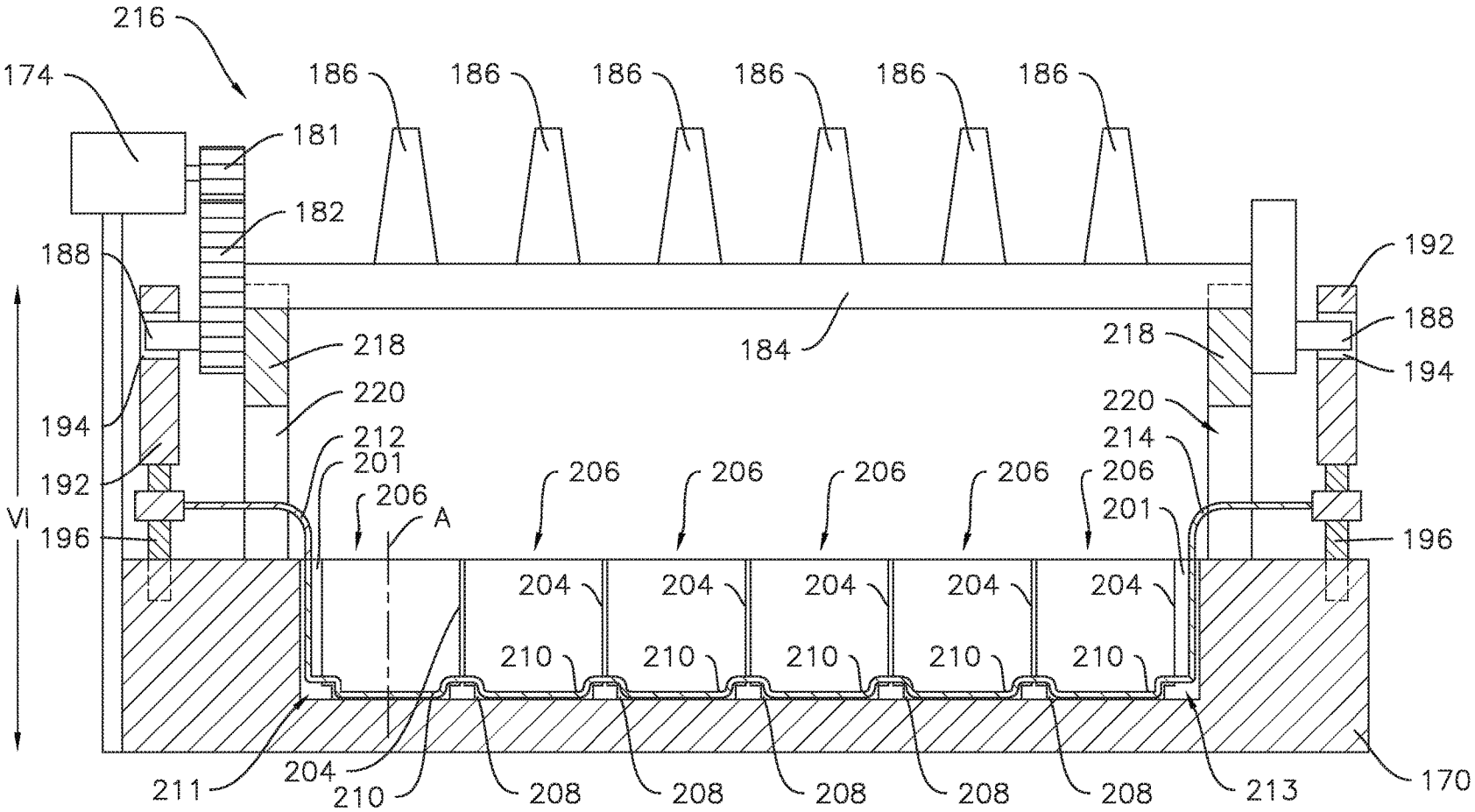
FIG. 6 provides a side section view of the ice maker of FIG. 4 with an ejector pad in a low position.
Figure 7:
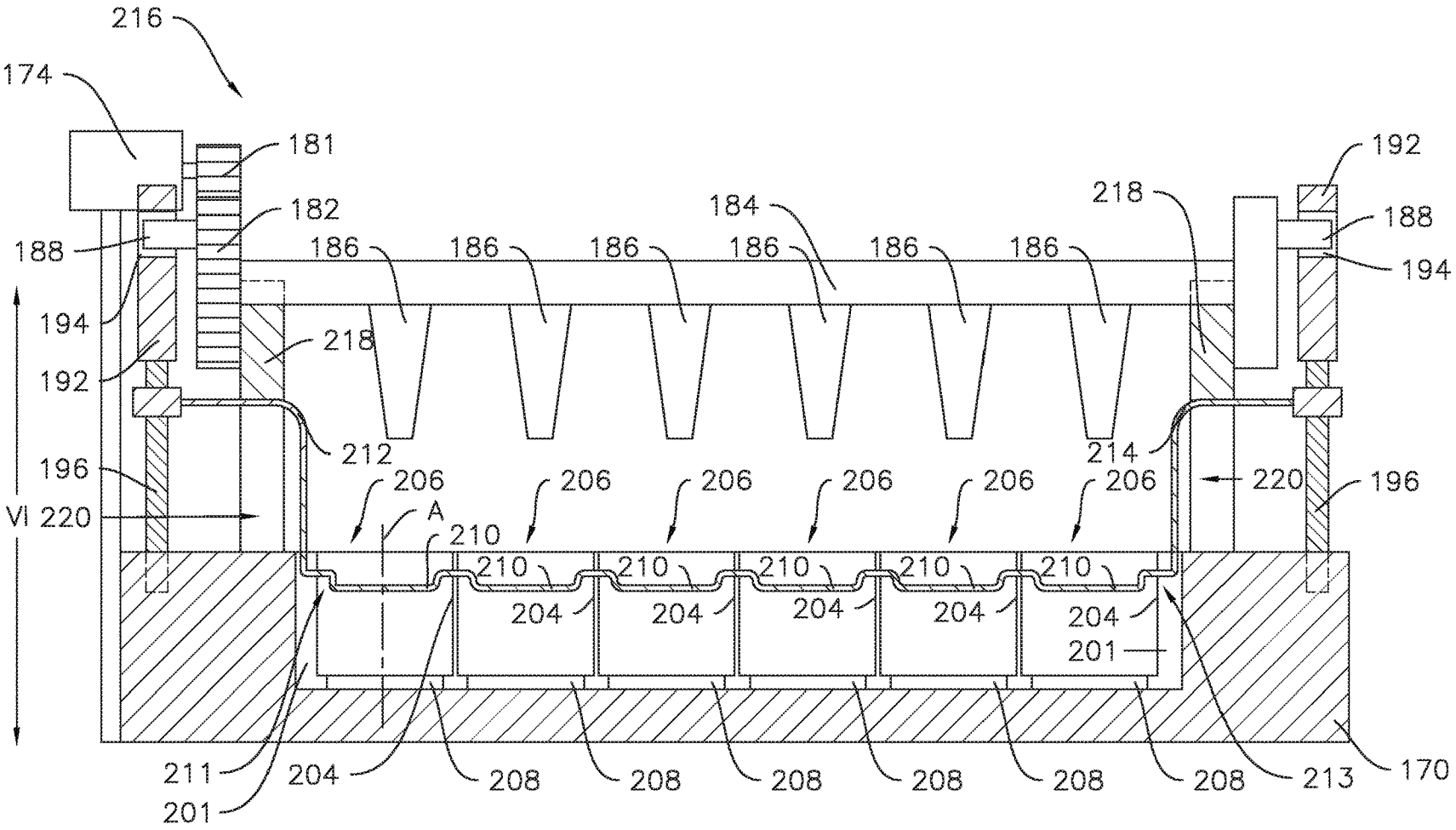
FIG. 7 provides a side section view of the ice maker of FIG. 4 with the ejector pad in a high position.

As best seen in FIGS. 6 and 7, the mold cavity extends between the floor 202 and an opening 206 along a longitudinal axis A. As may be seen in FIGS. 4 through 6, the mold cavity 200 is fully enclosed between the floor 202 and the opening 206 by at least one sidewall 204. For example, in the illustrated embodiments, the mold cavity 200 is generally cylindrical and thus is enclosed by a single continuous sidewall 204. As noted above, in other embodiments, the mold cavity 200 may be, e.g., hexagonal, and thus may include more than one, e.g., six, sidewalls 204 enclosing the mold cavity 200 between the floor 202 and the opening 204. The longitudinal axis A of the mold cavity 200 is oriented generally along the vertical direction VI of the ice maker 160, and may in some embodiments also be generally aligned with the vertical direction V of the refrigerator appliance 100. As seen in FIGS. 5 through 7, a recess 208 may be formed in the floor 202 of the mold cavity 200. The floor 202 of the mold cavity 200, including the recess 208 formed therein, defines a solid and continuous surface, such that there is no inherent potential leak path for liquid water in the mold cavity 200. For example, no openings or apertures are located in or through the floor 202 for the ejector pad 210 or any associated mechanisms.

The ice maker 160 may include at least one ejector pad 210, and, in various embodiments, an ejector pad 210 is provided in each mold cavity 200. In embodiments including multiple mold cavities 200 and multiple ejector pads 210, the ejector pads 210 in each adjacent mold cavity 200 may be connected together. The ejector pad 210 may be movable between a low position (FIG. 6) proximate the floor 202 and a high position (FIG. 7) proximate the opening 206. In embodiments including more than one ejector pad 210, the ejector pads 210 may advantageously be rigidly secured to one another so that the ejector pads 210 move in unison between the low position and the high position. The ejector pad 210 may be configured to be received within the recess 208 in the floor 202 of the mold cavity 200 when the ejector pad 210 is in the low position. For example, the recess 208 may be circular and the ejector pad 210 may have a similar shape, e.g., circular and with a similar diameter as the recess 208. As will be described in more detail below, the ejector pad 210 may be movable upward generally along the vertical direction VI from the low position to the high position. As mentioned, the ejector pad 210 is in or near the recess 208 in the floor 202 of the mold cavity 200 when the ejector pad 210 is in the low position. Further, when the ejector pad 210 is in the high position, the ejector pad 210 is proximate the opening 206 of the mold cavity 200. Accordingly, when ice is formed within the mold cavity 200, moving the ejector pad 210 from the low position to the high position may eject the ice from the mold cavity 200.

As may be seen in FIGS. 5 through 7, a first arm 212 may be connected to a first side 211 of the ejector pad 210 and a second arm 214 connected to a second side 213 of the ejector pad 210. As shown, the second side 213 of the ejector pad 210 is opposite the first side 211 of the ejector pad 210. As may be seen in FIGS. 6 and 7, the first arm 212 and the second arm 214 extend upward generally along the vertical direction VI from the first side 211 and the second 213 of the ejector pad 210, respectively.

In various embodiments, the motor 174 may be in operative communication with the first arm 212 and the second arm 214, such that the motor 174 is operable to move the ejector pad 210 generally along the vertical direction VI between the low position and the high position. For example, the ice maker 160 may include a gear 182 which is engaged by a drive gear 181 of the motor 174 such that activating the motor 174 causes the gear 182 to rotate. The gear 182 is illustrated schematically in FIGS. 4, 6, 7, and 9 for the sake of clarity, the structure and operation of a gear is well understood by those of skill in the art. The gear 182 may be connected to a rotatable shaft 184 such that the rotatable shaft 184 rotates when the gear 182 rotates.

In some embodiments, a cam 188 may be formed on the gear 182 and thus the cam 188 may be connected to the rotatable shaft 184 via the gear 182. The ice maker 160 may also include a scotch yoke 192 having an slot 194 formed in the scotch yoke 192. The cam 188 may be received in the slot 194 of the scotch yoke 192, whereby rotation of the gear 182 is translated into reciprocating linear movement by the scotch yoke 192. The slot 194 may be arcuate, e.g., as illustrated in FIG. 4, whereby the speed of movement may be slightly biased so the ejector pad 210 will lift a little more slowly at the beginning of harvest as ice formed in the mold body 170 breaks loose from the mold body 170 and the cam 188 is close to six o'clock and the ejector pad 210 will lift faster when the cam 188 is closer to twelve o'clock. Thus, in various embodiments, the motor 174 may be in operative communication with the first arm 212 and the second arm 214 via the gear 182, the cam 188, and the rotatable shaft 184.

In particular, the scotch yoke 192 may translate the rotation into upward linear movement along the vertical direction VI from the low position to the high position when the gear 184 rotates about one hundred eighty degrees (180°) and may translate the rotation into downward linear movement along the vertical direction VI from the high position to the low position when the gear 184 rotates an additional about one hundred eighty degrees (180°) to complete a revolution of the gear 184. Accordingly, the scotch yoke 192 may be connected to one of the first arm 212 and the second arm 214, whereby the linear movement along the vertical direction VI moves the ejector pad 210 between the low position and the high position. For example, as illustrated, the scotch yoke 192 may be connected to one of the first arm 212 and the second arm 214 by a vertical rod 196. The vertical rod 196 may be telescopic such that the rod 196 extends as the ejector pad 210 moves from the low position to the high position and contracts as the ejector pad 210 moves from the high position to the low position. Additionally, a second scotch yoke 192 may be provided at an opposite end of the rotatable shaft 184 in a similar fashion as described above and the second scotch yoke 192 may be connected to the other of the first arm 212 and the second arm 214. A notch 201 may be formed in the mold body 170 at opposite ends of the mold cavity 200 (or cavities, as in the illustrated example embodiments) where the first arm 212 and the second arm 214 can extend upward outside of the mold cavity 200 so as to avoid or minimize altering the shape of ice produced in the mold body 170 due to the presence of the first and second arms 212 and 214.

Figure 8:
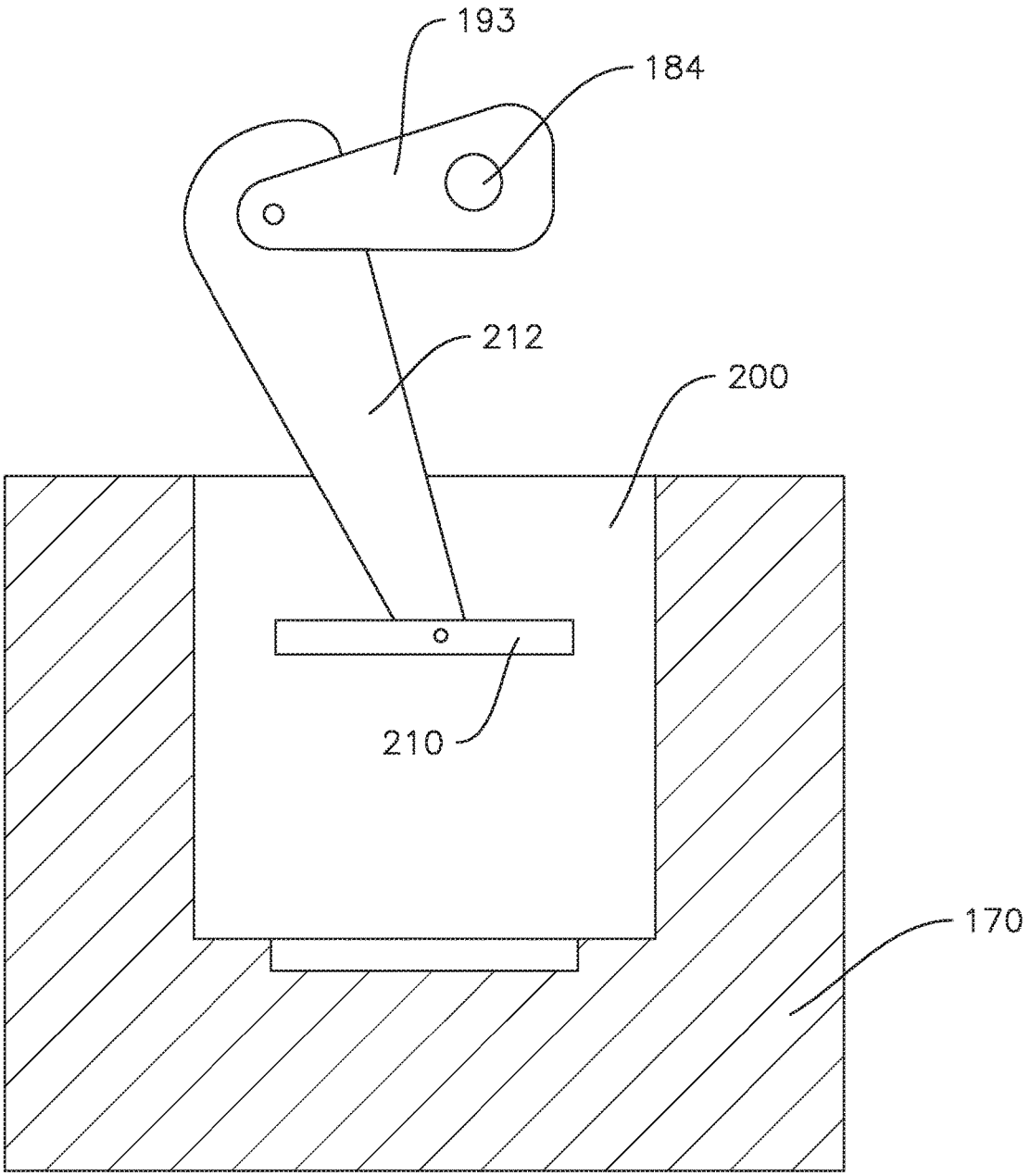
FIG. 8 provides a transverse section view of an ice maker according to one or more embodiments of the present subject matter.
Figure 9:
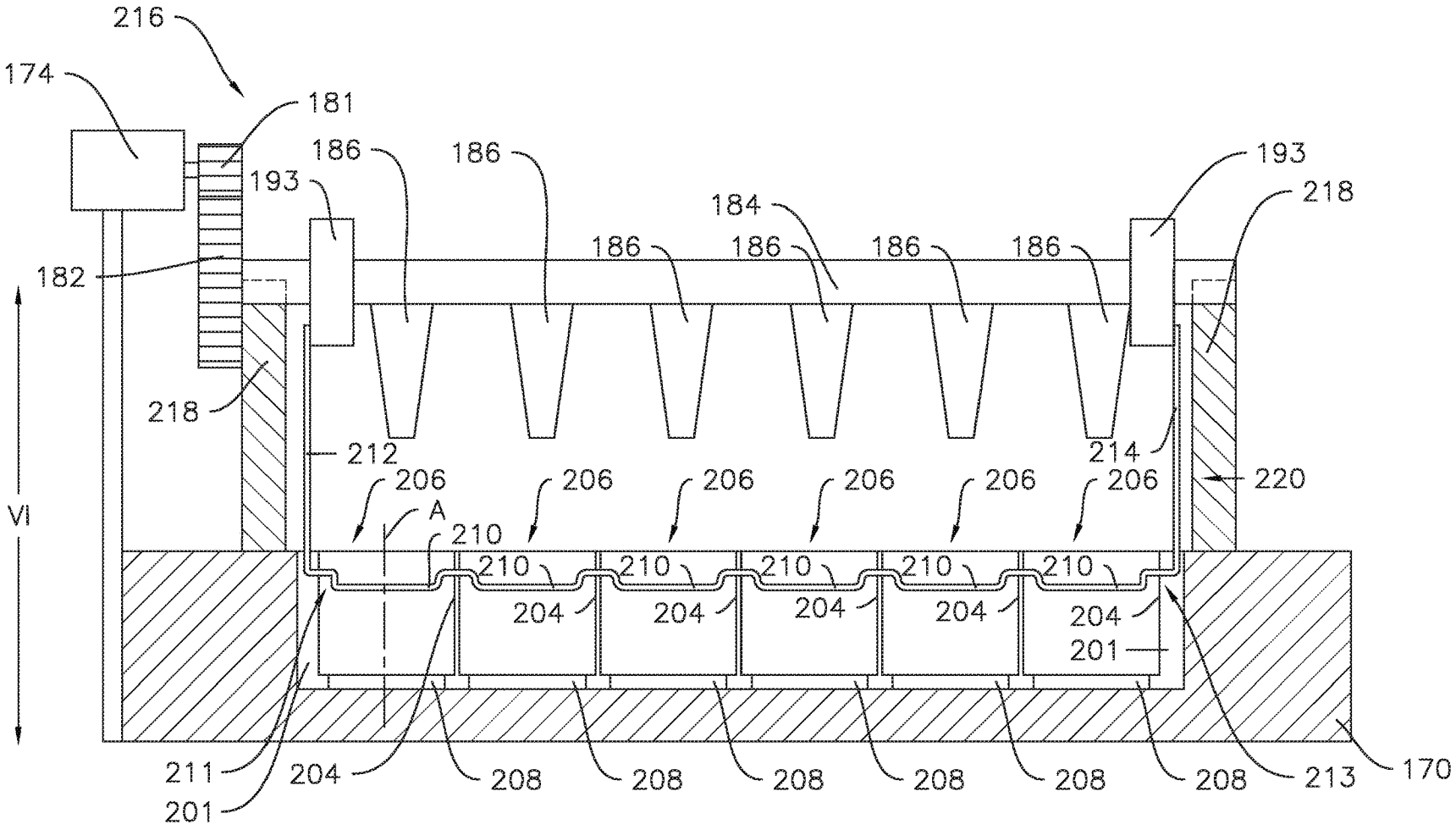
FIG. 9 provides a longitudinal section view of the ice maker of FIG. 8.

In some embodiments, for example as illustrated in FIGS. 8 and 9, a crank 193 may be connected to or otherwise provided on the rotatable shaft 184. One of the first arm 212 and the second arm 214 may be rotatably connected, such as by a pin connection, to the crank 193 at one end of the arm 212 or 214 and rotatably connected to the ejector pad 210 at the other end of the arm 212 or 214. Accordingly, in such embodiments, the arm 212 or 214 may be a connecting rod whereby the crank 193 and connecting rod 212 or 214 translate rotational motion of the rotatable shaft 184 into linear motion of the ejector pad 210 between the low position and the high position, in a similar manner as described above with respect to the scotch yoke 192. As shown in FIG. 9, two cranks 193 may be provided, each crank 193 connected to a respective one of the first arm 212 and the second arm 214.

The rotatable shaft 184 may be held in position and structurally supported above the mold body 170 by a strut or wall 218. The wall 218 may extend vertically, e.g., generally along the vertical direction V and/or VI, between the mold body 170 and the rotatable shaft 184. A slot 220 may be formed in the wall 218 such that one of the first arm 212 and the second arm 214 may pass through the wall 218. The slot 220 may define a vertical dimension, e.g., a height, sufficient to allow the one of the first arm 212 and the second arm 214 to move from the low position to the high position without interference from the wall 218. Additionally, as shown in FIGS. 4-7, a second wall 218 may be provided which is identical to the wall 218 as described and shown. For example, the other of the first arm 212 and the second arm 214 may pass through a slot 220 in the second wall 218.

As shown in FIGS. 4, 6, 7, and 9, the ice maker 160 may include an ice rake 216 positioned above the mold body 170 along the vertical direction VI. The ice rake includes a rotatable shaft, e.g., the rotatable shaft 184 as described above, and at least one rake finger 186 extending radially outward from the rotatable shaft 184. In various embodiments, any suitable number of fingers 186 may be provided, e.g., the number of rake fingers 186 corresponds to the number of mold cavities 200, and may be six, as shown in the example illustrated by FIG. 6, or more or fewer as desired. As mentioned above, the ejector pad 210 may eject ice from the mold cavity 200 by moving the ejector pad 210 from the low position to the high position. The ice rake 216 may be operable to dislodge the ice from the ejector pad 210 and/or mold cavity 200 and direct the ice towards the ice storage bin 164. For example, the ice maker 160 may be configured, e.g., the fingers 186 of the ice rake 216 may be positioned on the rotatable shaft 184, such that the fingers 186 of the ice rake 216 pass over and close to the mold body 170 when the rotatable shaft 184 rotates to or towards the high position of the ejector pad 210. In particular, the rake fingers 186 sweep over the mold cavities 200 in a direction towards the ice storage bin 164 to direct the ice from the mold body 170 towards the ice storage bin 164. The rake fingers 186 may define a path of rotation, e.g., as the rotatable shaft 184 rotates, the fingers 186 extending therefrom may travel through a generally circular path. The rake fingers 186 may be positioned and oriented on the rotatable shaft 184 such that the rake fingers 186 pass through a bottom point of the path of rotation with respect to the mold body 170 when the ejector pad 210 is in or approaches the high position. For example, the bottom point of the path of rotation may be the closest point of the rake fingers 186 to the mold body 170, e.g., where the rotatable shaft 184 is above the mold body 170. Accordingly, rotation of the rotatable shaft 184 may simultaneously eject ice upward out of the mold cavity 200 with the ejector pad 210 and dislodge the ice from the mold body 170 and direct the ice into the ice storage bin 164 with the rake fingers 186.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice maker defining a vertical direction, the ice maker comprising:

a mold body comprising a mold cavity, the mold cavity extending between a floor and an opening along a longitudinal axis, the mold cavity fully enclosed by at least one sidewall between the floor and the opening, the longitudinal axis of the mold cavity oriented generally along the vertical direction;

an ejector pad disposed proximate to the floor of the mold cavity when the ejector pad is in a low position;

a first arm connected to a first side of the ejector pad and extending upward generally along the vertical direction from the first side of the ejector pad;

a second arm connected to a second side of the ejector pad, the second side of the ejector pad opposite the first side of the ejector pad, the second arm extending upward generally along the vertical direction from the second side of the ejector pad; and a motor in operative communication with the first arm and the second arm, the motor operable to move the ejector pad upward generally along the vertical direction from the low position to a high position proximate the opening of the mold cavity, wherein the ejector pad is operable to eject ice from the mold cavity when the ejector pad moves from the low position to the high position.

2. The ice maker of claim 1, wherein the floor of the mold cavity defines a solid and continuous surface.

3. The ice maker of claim 1, further comprising an ice rake positioned above the mold body along the vertical direction, the ice rake comprising a rotatable shaft and a rake finger extending radially outward from the rotatable shaft.

4. The ice maker of claim 1, wherein the motor is in operative communication with the first arm and the second arm via a rotatable shaft.

5. The ice maker of claim 4, wherein the rotatable shaft includes a rake finger extending radially outward from the rotatable shaft.

6. The ice maker of claim 4, further comprising a cam connected to the rotatable shaft.

7. The ice maker of claim 6, wherein the cam is connected to one of the first arm and the second arm of the ejector pad via a scotch yoke, whereby rotation of the rotatable shaft and the cam connected thereto is translated into linear movement to move the ejector pad from the low position to the high position.

8. The ice maker of claim 7, wherein the rotatable shaft includes a rake finger extending radially outward from the rotatable shaft, the rake finger defines a path of rotation, and the rake finger passes through a bottom point of the path of rotation with respect to the mold body as the ejector pad approaches the high position.

9. The ice maker of claim 4, further comprising a crank connected to the rotatable shaft, wherein one of the first arm and the second arm is rotatably connected to the crank.

10. The ice maker of claim 4, further comprising a wall extending generally along the vertical direction between the mold body and the rotatable shaft.

11. A refrigerator appliance defining a vertical direction, a lateral direction, and a transverse direction, the vertical, lateral, and transverse directions being mutually perpendicular, the refrigerator appliance comprising:

a cabinet defining a chilled chamber;

an ice maker disposed within the cabinet, the ice maker comprising:

a mold body comprising a mold cavity, the mold cavity extending between a floor and an opening along a longitudinal axis, the longitudinal axis of the mold cavity oriented generally along the vertical direction;

an ejector pad disposed proximate to the floor of the mold cavity when the ejector pad is in a low position;

a first arm connected to a first side of the ejector pad and extending upward generally along the vertical direction from the first side of the ejector pad;

a second arm connected to a second side of the ejector pad, the second side of the ejector pad opposite the first side of the ejector pad, the second arm extending upward generally along the vertical direction from the second side of the ejector pad; and a motor in operative communication with the first arm and the second arm, the motor operable to move the ejector pad upward generally along the vertical direction from the low position to a high position proximate the opening of the mold cavity, wherein the ejector pad is operable to eject ice from the mold cavity when the ejector pad moves from the low position to the high position.

12. The refrigerator appliance of claim 11, wherein the floor of the mold cavity defines a solid and continuous surface.

13. The refrigerator appliance of claim 11, further comprising an ice rake positioned above the mold body along the vertical direction, the ice rake comprising a rotatable shaft and a rake finger extending radially outward from the rotatable shaft.

14. The refrigerator appliance of claim 11, wherein the motor is in operative communication with the first arm and the second arm via a rotatable shaft.

15. The refrigerator appliance of claim 14, wherein the rotatable shaft includes a rake finger extending radially outward from the rotatable shaft.

16. The refrigerator appliance of claim 14, further comprising a crank connected to the rotatable shaft, wherein one of the first arm and the second arm is rotatably connected to the crank.

17. The refrigerator appliance of claim 14, further comprising a cam connected to the rotatable shaft.

18. The refrigerator appliance of claim 17, wherein the cam is connected to one of the first arm and the second arm of the ejector pad via a scotch yoke, whereby rotation of the rotatable shaft and the cam connected thereto is translated into linear movement to move the ejector pad from the low position to the high position.

19. The refrigerator appliance of claim 14, wherein the rotatable shaft includes a rake finger extending radially outward from the rotatable shaft, the rake finger defines a path of rotation, and the rake finger passes through a bottom point of the path of rotation with respect to the mold body as the ejector pad approaches the high position.

20. The refrigerator appliance of claim 14, further comprising a wall extending generally along the vertical direction between the mold body and the rotatable shaft.

* * * * *